US008510876B2

(12) United States Patent
Sakemi et al.

(10) Patent No.: US 8,510,876 B2
(45) Date of Patent: Aug. 20, 2013

(54) DRAIN VALVE DEVICE FOR CLEANING WATER TANK, AND DRAIN VALVE FOR DRAIN VALVE DEVICE

(75) Inventors: Koji Sakemi, Fukuoka (JP); Yoshihiko Morokuma, Fukuoka (JP)

(73) Assignee: Toto Ltd. (JP)

( * ) Notice: Subject to any disclaimer, the term of this patent is extended or adjusted under 35 U.S.C. 154(b) by 785 days.

(21) Appl. No.: 12/568,516

(22) Filed: Sep. 28, 2009

(65) Prior Publication Data

US 2010/0077545 A1 Apr. 1, 2010

(30) Foreign Application Priority Data

Sep. 30, 2008 (JP) ..... 2008-255438

(51) Int. Cl.
*E03D 1/35* (2006.01)
*E03D 1/34* (2006.01)

(52) U.S. Cl.
USPC ..... 4/392; 4/378

(58) Field of Classification Search
USPC ..... 4/378–419
See application file for complete search history.

(56) References Cited

U.S. PATENT DOCUMENTS 3,775,778 A * 12/1973 Lee ..... 4/325
4,497,076 A * 2/1985 Sullivan ..... 4/392
5,293,650 A 3/1994 Schoepe et al.
5,524,297 A * 6/1996 Harrison ..... 4/325
5,699,563 A * 12/1997 McClure ..... 4/325
5,933,878 A 8/1999 Suehiro et al.
6,192,526 B1 2/2001 Nichols-Roy et al.
6,381,765 B1 5/2002 Liu

FOREIGN PATENT DOCUMENTS

JP 9-291580 11/1997

* cited by examiner

*Primary Examiner* — Gregory Huson
*Assistant Examiner* — Christine Skubinna
(74) *Attorney, Agent, or Firm* — Studebaker & Brackett PC

(57) ABSTRACT

A drain valve device and a drain valve for a cleaning water tank are disclosed. A drain valve device for a cleaning water tank which stores a cleaning water for cleaning a toilet bowl, comprises a drain valve main body including a supporting shaft extending in a horizontal direction and a valve seat attached to a draining port formed at a bottom surface of the cleaning water tank, and a drain valve including an engaging portion which engages with the supporting shaft and is capable of swinging in a vertical direction, and a valve body, connected with the engaging portion through an extending portion, for carrying out a water discharge and a water stop when contacting with or separating from the valve seat by swinging in a vertical direction. The drain valve main body includes a first projection which projects upwardly, when a conformable drain valve is attached as the drain valve, the drain valve main body enables carrying out a water discharge and a water stop, without the first projection abutting against the conformable drain valve, and when a non-conformable drain valve is attached as the drain valve, the drain valve main body disenables carrying out a water stop, with the first projection abutting against a second projection provided at the non-conformable drain valve.

4 Claims, 10 Drawing Sheets

DRAIN VALVE DEVICE FOR CLEANING WATER TANK, AND DRAIN VALVE FOR DRAIN VALVE DEVICE

BACKGROUND OF THE INVENTION

1. Field of the Invention

The present invention relates to a drain valve device for a cleaning water tank, and a drain valve for the drain valve device.

2. Description of the Related Art

Conventionally, although a flapper valve or a drain valve is used for carrying out a water discharge and a water stop by opening and closing a draining port, in a cleaning water tank for storing a cleaning water to clean a toilet bowl, the flapper valve would be deteriorated and/or worn by being exposed in water for a long period of time, and by carrying out the opening and closing operations repeatedly, when the flapper valve used for a long period of time.

As a result, the deteriorated flapper valve becomes deformed and/or a pinhole is formed therein, and a water-tightness is no longer maintained, thereby causing a water leakage. For this reason, it is configured so that the deteriorated flapper valve is replaced with a new flapper valve.

When changing the flapper valve, occasionally a worker may attach a non-conformable flapper valve mistakenly, since there are different types of flapper valves, in matching the specifications of the cleaning water tanks.

However, as disclosed in JP-A-9-291580, for example, since a mechanism for preventing a non-conformable flapper valve from being attached is not provided in the conventional drain valve device for the cleaning water tank, there is only the way such that the worker needs to replace a conformable flapper valve, and as a result, it has been difficult to securely prevent the non-conformable flapper valve from being attached.

As described above, at the time of changing a flapper valve, when a non-conformable flapper valve is attached, there is a problem such that an amount of cleaning water discharged from a cleaning water tank becomes more than a required amount, or less than the required one, and as a result, a predetermined cleaning function could not be performed.

In order to solve such problems, the inventors of the present invention have found effective prevention measures by conducting the various kinds of investigations and examinations, etc.

SUMMARY OF THE INVENTION

It is therefore an object of the present invention to provide a drain valve device for a cleaning water tank, and a drain valve for the drain valve device, which are capable of securely preventing a non-conformable flapper valve from being attached, when exchanging a drain valve.

The above object is achieved according to the present invention by providing a drain valve device for a cleaning water tank which stores a cleaning water for cleaning a toilet bowl, the drain valve device comprising a drain valve main body including a supporting shaft extending in a horizontal direction and a valve seat attached to a draining port formed at a bottom surface of the cleaning water tank, and a drain valve including an engaging portion which engages with the supporting shaft and is capable of swinging in a vertical direction, and a valve body, connected with the engaging portion through an extending portion, for carrying out a water discharge and a water stop when contacting with or separating from the valve seat by swinging in a vertical direction, wherein the drain valve main body includes a first projection which projects upwardly, when a conformable drain valve is attached as the drain valve, the drain valve main body enables carrying out a water discharge and a water stop, without the first projection abutting against the conformable drain valve, and when a non-conformable drain valve is attached as the drain valve, the drain valve main body disenables carrying out a water stop, with the first projection abutting against a second projection provided at the non-conformable drain valve.

In the present invention described above, the drain valve main body includes the first projection which projects upwardly, and since the first projection does not abut against the drain valve when the conformable drain valve is attached thereto as the drain valve, the drain valve operates the opening and closing smoothly, thereby enabling to carry out a water discharge and a water stop, while when the non-conformable drain valve is attached thereto as the drain valve, since the first projection of the drain valve main body abuts against the second projection, which projects downwardly, provided at the non-conformable drain valve, it disables to carry out a water stop. Accordingly, a worker who exchanges the drain valve will immediately notice that the non-conformable drain valve has been attached thereto, since no cleaning water is stored in the cleaning water tank. As a result, according to the present invention, it is possible to securely prevent the non-conformable drain valve from being attached.

In the present invention, preferably, the second projection of the non-conformable drain valve is provided at an extending portion of the drain valve, and the first projection of the drain valve main body is provided at a location which corresponds to the second projection.

According to the present invention described above, when the non-conformable drain valve is attached, the drain valve disenables carrying out a water stop since the second projection provided in the extending portion of the non-conformable drain valve abuts against the first projection of the drain valve main body. Accordingly, the worker who exchanges the drain valve will immediately notice that the non-conformable drain valve has been attached thereto, since no cleaning water is stored in the cleaning water tank. As a result, according to the present invention, the non-conformable drain valve is securely prevented from attached.

Further, since the first projection of the drain valve body is provided at a location which corresponds to the second projection provided at the extending portion of the drain valve, when the conformable drain valve is attached, the first projection does not serve as a resistance at the time when the cleaning water is discharged from the draining port, thereby enabling to demonstrate a good discharge function.

In the present invention, preferably, the second projection of the non-conformable drain valve is provided at a predetermined location on a periphery of the valve body of the drain valve, and the first projection of the drain valve main body is provided at a location which corresponds to the second projection.

According to the present invention described above, when the non-conformable drain valve is attached, the drain valve disables carrying out a water stop, since the second projection provided at the predetermined location on the periphery of the valve body in the non-conformable drain valve abuts against the first projection in the drain valve main body. Accordingly, the worker who exchanges the drain valve will immediately notice that the non-conformable drain valve has been attached thereto, since no cleaning water is stored in the cleaning water tank, thereby enabling to securely prevent the non-conformable drain valve from being attached.

Further, since the first projection of the drain valve main body is provided at the predetermined location on the periphery of the valve body in the drain valve, when the non-conformable drain valve is attached, it enables to securely prevent a trouble from occurring, in which the valve is closed by mistake as a water pressure functions to press the valve body downwardly at the time of discharging the cleaning water.

In the present invention, preferably, the first projection of the drain valve main body or the second projection of the non-conformable drain valve has a length so that it enables abutting against the second projection of the drain valve or the first projection of the drain valve main body, respectively, when the drain valve is displaced or moved in a direction in which the supporting shaft extends.

According to the present invention described above, even when the drain valve is displaced or moved in the direction in which the supporting shaft extends, it disables to carry out a water stop, since the first projection abuts against the second projection. Accordingly, the worker who exchanges the drain valve will immediately notice that the non-conformable drain valve has been attached thereto, since no cleaning water is stored in the cleaning water tank, thereby enabling to securely prevent the non-conformable drain valve from being attached.

Further, it is not required to newly provide a regulating member, etc. for preventing the drain valve from being displaced or moved, in order to make the projections to abut against each other. Accordingly, it enables a production cost and an environmental load to be reduced.

The above object is also achieved according to the present invention by providing a drain valve for use in a drain valve device of a cleaning water tank which stores a cleaning water for cleaning a toilet bowl, the drain valve device comprising a drain valve main body which includes a supporting shaft extending in a horizontal direction, and a valve seat attached to a draining port formed at a bottom surface of the cleaning water tank, the drain valve comprising an engaging portion which engages with the supporting shaft and is capable of swinging in a vertical direction, a valve body, connected with the engaging portion through an extending portion, for carrying out a water discharge and a water stop when contacting with or separating from the valve seat by swinging in a vertical direction, and a second projection which projects downwardly, wherein the drain valve enables carrying out a water discharge and a water stop, when the drain valve is attached to the drain valve main body as a conformable drain valve, and the drain valve disenables carrying out a water stop, when the drain valve is attached to a drain valve main body, which is different from the drain valve main body, as a non-conformable drain valve, with the second projection abutting against a first projection projecting upwardly provided at the different drain valve main body.

According to the present invention described above, when the drain valve is attached to the drain valve main body as the conformable drain valve, the drain valve operates the opening and closing smoothly, thereby enabling carrying out a water discharge and a water stop, while when the drain valve is attached to a drain valve main body which is different from the drain valve main body as the non-conformable drain valve, it disables to carry out a water stop since the second projection of the drain valve abuts against the first projection, which projects upwardly, provided at the different drain valve main body. Accordingly, a worker who exchanges the drain valve will immediately notice that the non-conformable drain valve has been attached thereto, since no cleaning water is stored in the cleaning water tank. As a result, according to the present invention, it is possible to securely prevent the non-compliant drain valve from being attached.

DETAILED DESCRIPTION OF THE PREFERRED EMBODIMENTS

Hereinafter, a drain valve device for a cleaning water tank, and a drain valve for the drain valve device according to the preferred embodiments of the present invention will be described with reference to FIGS. 1 to 10.

Figure 1:
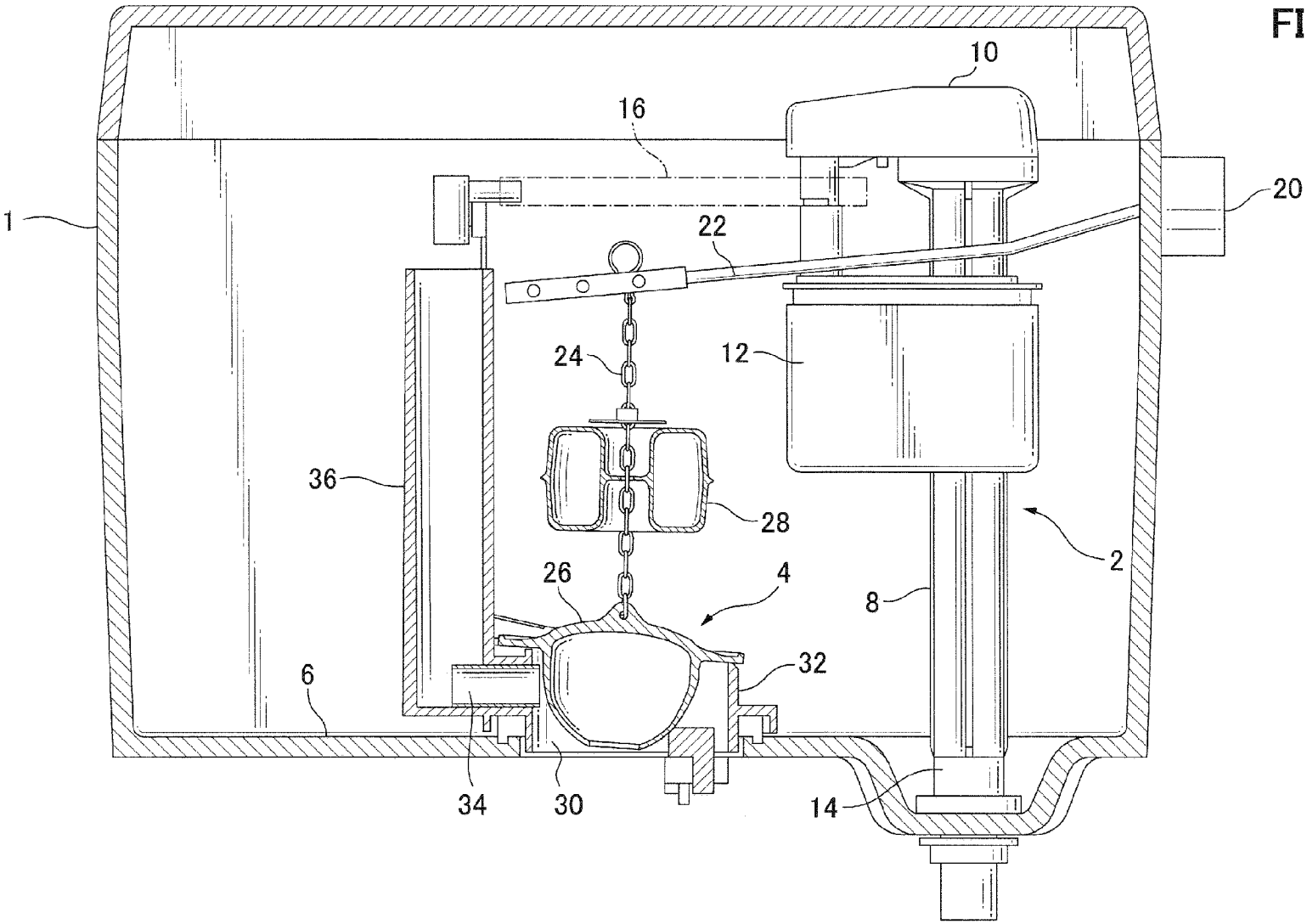
FIG. 1 is a cross sectional view showing a cleaning water tank to which a drain valve device of the present invention is applicable.

First, with reference to FIG. 1, a cleaning water tank to which the drain valve device of the present invention is applied will be described. FIG. 1 is a cross sectional view showing the cleaning water tank to which the drain valve device of the present invention is applied.

The cleaning water tank 1 shown in FIG. 1 is attached to a toilet bowl (not shown), and is configured to discharge a cleaning water to the toilet bowl. The cleaning water tank 1 is such that an amount of the cleaning water to be stored differs according to a type of the toilet.

As shown in FIG. 1, within the cleaning water tank 1, there are provided a water supply device 2 for supplying and storing the cleaning water within the cleaning water tank 1, and a drain valve device 4 for discharging the cleaning water stored in the cleaning water tank 1 to the toilet bowl.

The water supply device 2 includes a water feed pipe 8 connected with an external water supply source and upwardly extending from a bottom surface 6 of the water supply tank 1, a water supply valve 10 attached to an upper end of the water feed pipe 8, for switching a water discharge and a water stop of the cleaning water supplied from the water feed pipe 8 into the cleaning water tank 1, and a float 12 for switching the water discharge and a water stop with the water supply valve 10 by moving vertically according to a fluctuation of a water level within the cleaning water tank 1.

A spouting port 14 is opened at a lower end on a periphery side of the water feed pipe 8, and the cleaning water supplied from the water supply valve 10 is spouted through the spouting port 14 into the cleaning water tank 1.

The water supply device 2 further includes a refill pipe 16 connected with the water supply valve 10, and a lower end of the refill pipe 16 is located at an upper end opening of a overflow pipe 36.

In the water supply device 2, when the cleaning water in the cleaning water tank 1 is discharged to the toilet bowl with the drain valve device 4, a water level of the cleaning water is lowered, and the float 12 moves downwardly, thereby opening the water supply valve 10, and starting a water spout from the spouting port 14, and thus a water spout into the cleaning water tank 1 is started. Then, when the water spout is continued and the water level is elevated, the float 12 moves upwardly, thereby closing the water supply valve 10, and the spout port 14 is water stopped. Accordingly, the water level of the cleaning water in the cleaning water tank 1 is maintained to a predetermined water level at a time of full capacity.

Hereinafter, the drain valve device 4 will be described. As shown in FIG. 1, the drain valve device 4 includes an operating lever 20 attached to the cleaning water tank 1, a rotary shaft 22 attached to the operating lever 20 and located in the cleaning water tank 1 to be rotated by the operating lever 20, a chain 24 attached to the other end of the rotary shaft 22 to be moved vertically by a rotation of the rotary shaft 22, a flapper valve 26 that is a drain valve attached to a lower end of the chain 24, a float 28 attached to the chain 24 at a location above the flapper valve 26 at a predetermined distance therefrom, a draining port 30 formed at the bottom surface 6 of the cleaning water tank 1 to be opened and closed by the flapper valve 26, and a drain valve main body 32 provided at the draining port 30. The drain valve main body 32 is provide with an overflow pipe 36 which is provided so as to communicate with the draining port 30 through an internal passage 34.

Figure 5:
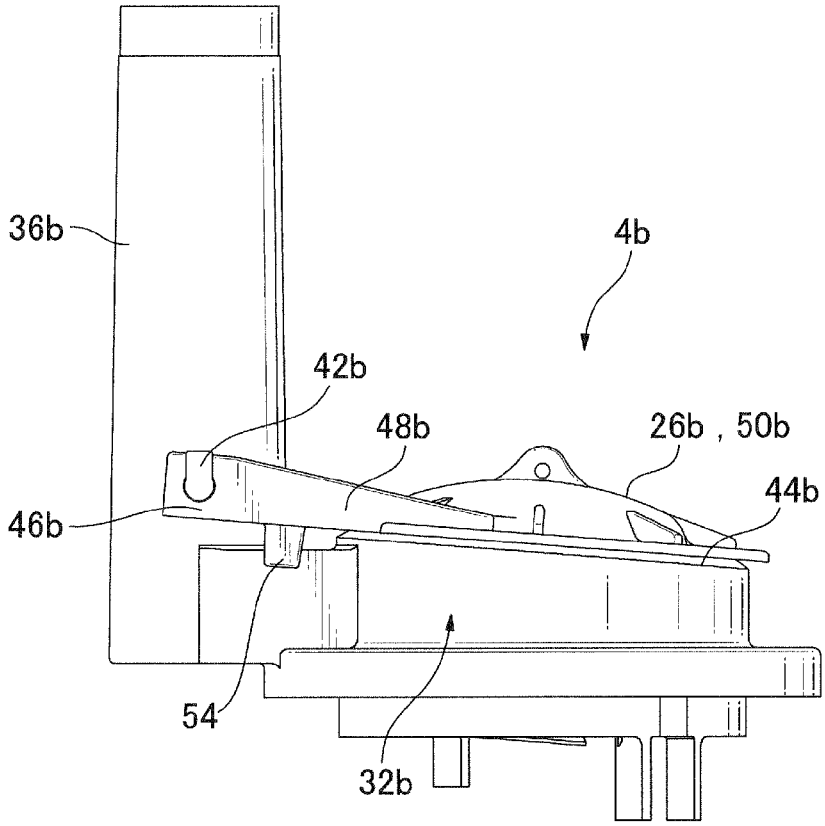
FIG. 5 is a front view showing a second type drain valve device according to an embodiment of the present invention.
Figure 6:
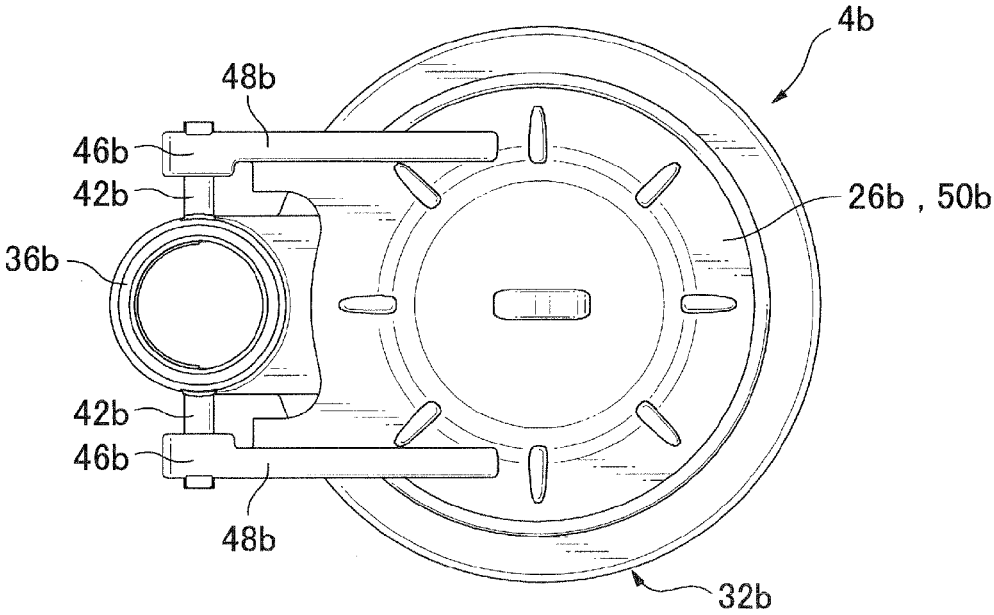
FIG. 6 is a plan view of FIG. 5.
Figure 7:
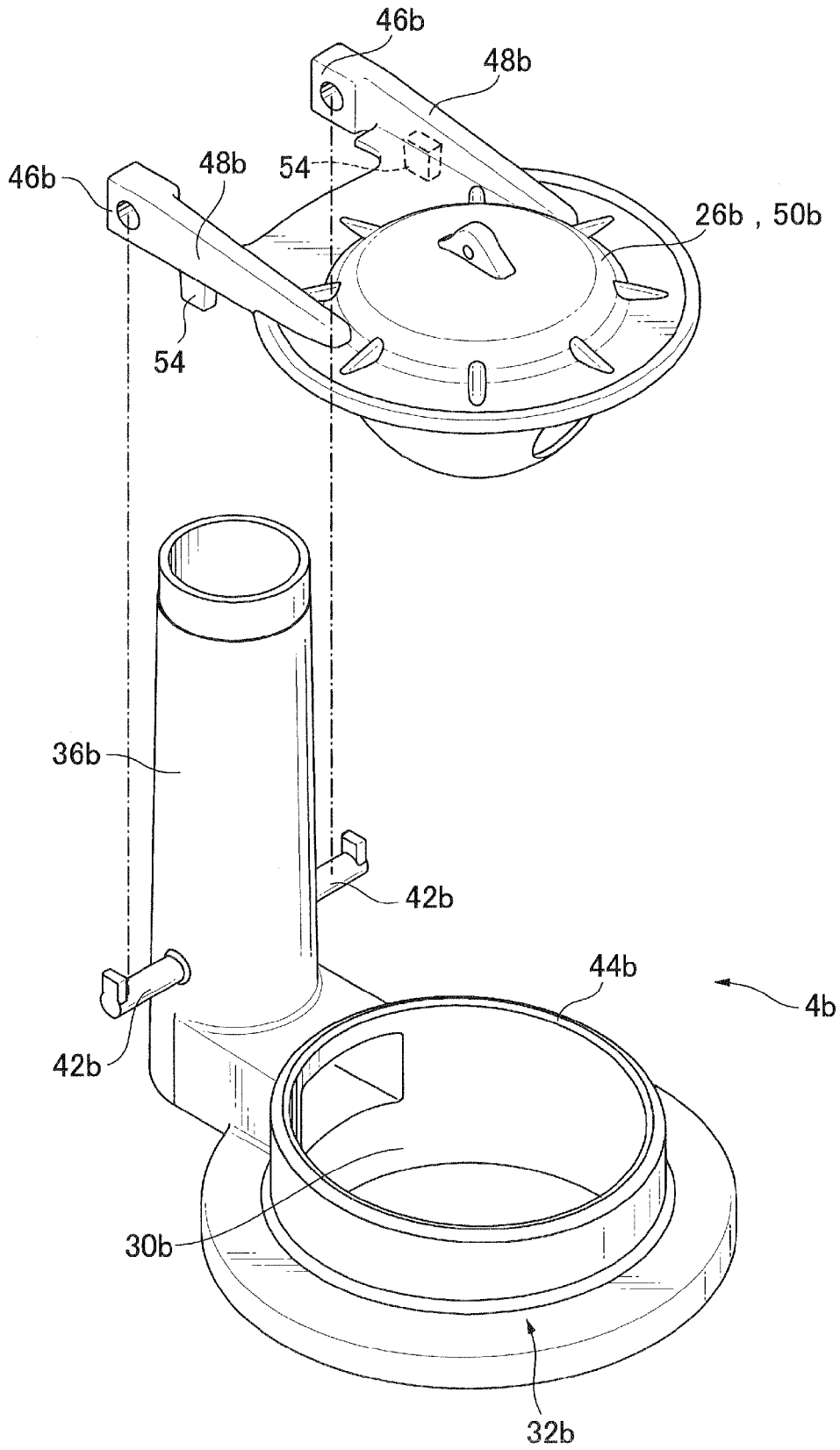
FIG. 7 is an exploded view showing the parts of the second type drain valve device according to the embodiment of the present invention.

Hereinafter, with reference to FIGS. 2-7, the drain valve device according to the embodiment of the present invention will be described. At least two types of drain valve devices are applicable in the embodiment of the present invention. That is, a first type of a drain valve device 4*a* attached to the cleaning water tank having a high silhouette as shown in FIGS. 2-4, and a second type of a drain valve device 4*b* attached to the cleaning water tank having a low silhouette as shown in FIGS. 5-7 are respectively applicable.

In the following descriptions, "a" and "b" are added to the respective reference numerals in the first type drain valve device 4*a* and the second type drain valve device 4*b*.

Figure 2:
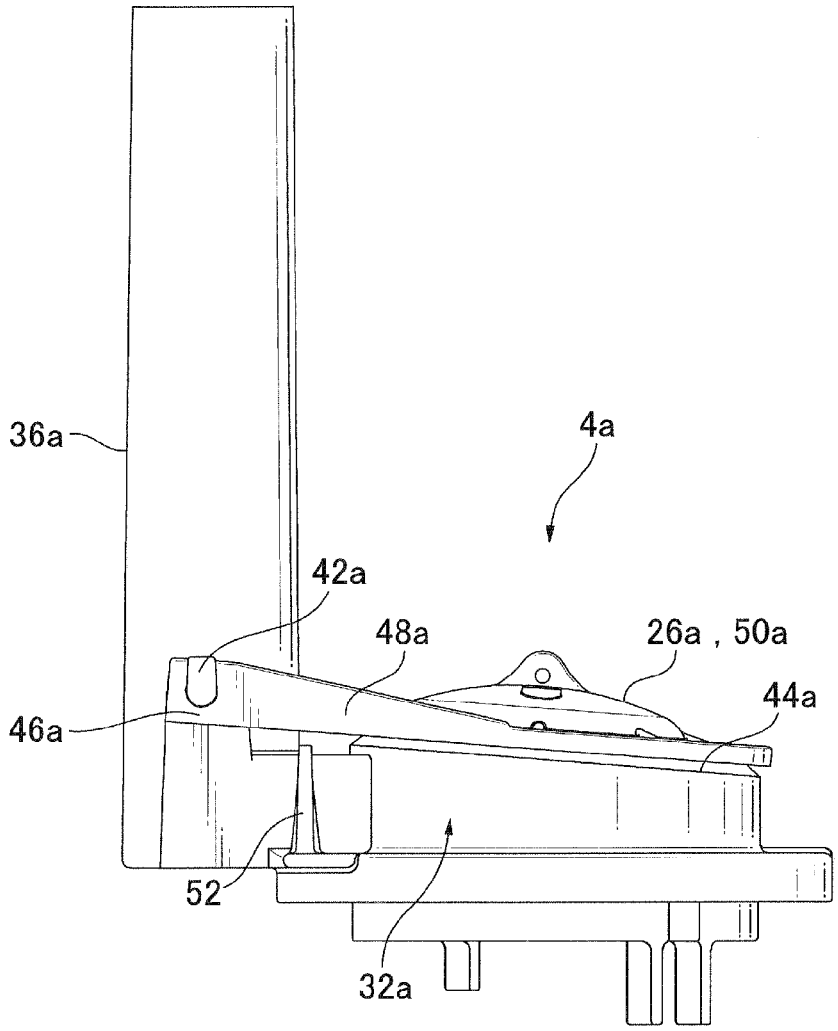
FIG. 2 is a front view showing a first type drain valve device according to an embodiment of the present invention.
Figure 3:
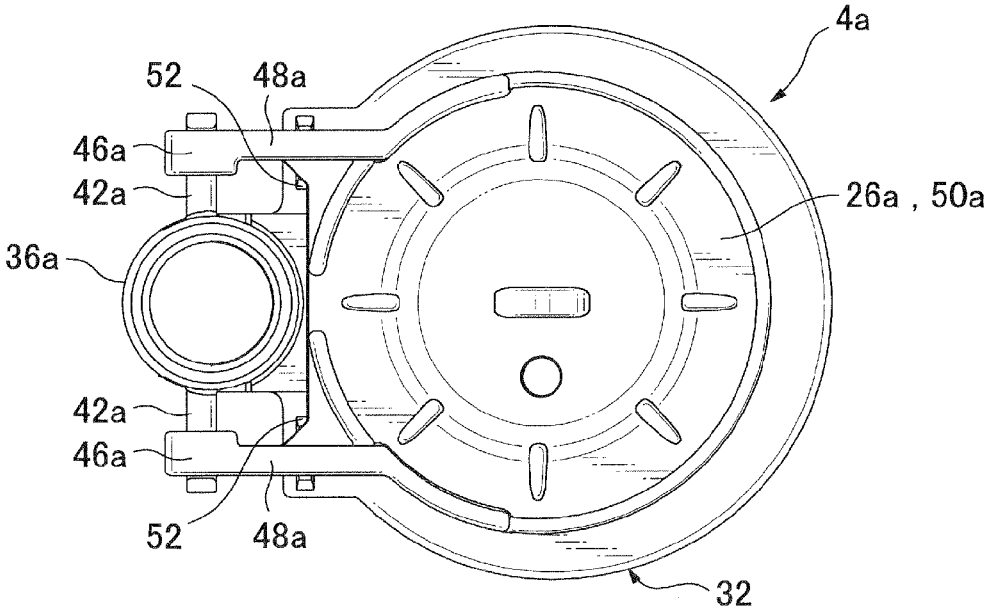
FIG. 3 is a plan view of FIG. 2.
Figure 4:
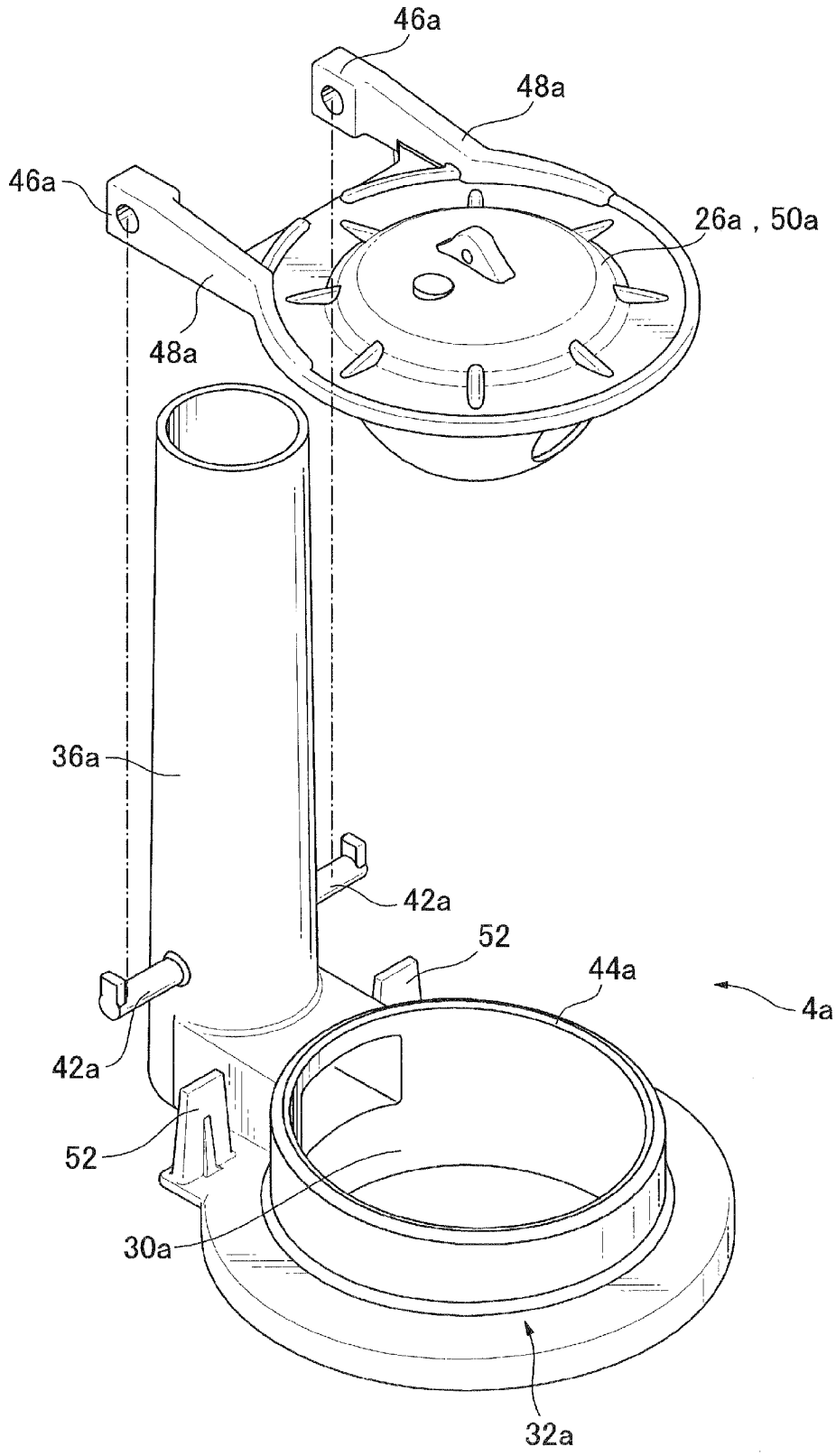
FIG. 4 is an exploded view showing the parts of the first type drain valve device according to the embodiment of the present invention.

FIG. 2 is a front view showing the first type of drain valve device 4*a* according to the embodiment of the present invention, FIG. 3 is a plane view of FIG. 2, and FIG. 4 is an exploded view showing the parts of the first type of drain valve 4*a* according to the embodiment of the present invention.

As shown in FIGS. 2-4, the first type drain valve device 4*a* includes a flapper valve 26*a* that is a drain valve, and a drain valve main body 32*a*. Herein, the drain valve main body 32*a* includes a pair of supporting shafts 42*a* extending from a lower side of the overflow pipe 36*a* in a horizontal direction, and a valve seat 44*a* attached to the draining port 30*a* formed at the bottom surface 7 of the cleaning water tank 1.

The flapper valve 26*a* includes an engaging portions 46*a* which engage with the supporting shafts 42 and are capable of swinging in a vertical direction, a valve body 50*a*, connected with the engaging portions 46*a* through extending portions 48*a*, for carrying out a water discharge and a water stop when contacting with and separating from the valve seat 44*a* by swinging in the vertical direction.

Further, in the first type drain valve device 4*a*, a pair of projections (first projections) 52 which upwardly project are formed at a portion located below the extending portions 48*a* of the flapper valve 26*a* in the drain valve main body 32*a*. The projections 52 of the drain valve main body 32*a* in the first type drain valve device 4*a* are formed at a location where the projections 52 abut against hereinafter described projections (second projections) 54 which project downwardly and are formed at extending portions 48*b* of a flapper valve 26*b*, when the flapper valve 26*b* of the second type drain valve device 4*b* is used as the non-conformable flapper valve of the first type drain valve device 4*a*

In the first type drain valve device 4*a* as described above, the flapper valve 26*a* does not abut against the projection (the first projection) 52 which projects above the drain valve main body 32*a*, even when the flapper valve 26*a* carries out a water discharge and a water stop of the cleaning water by swinging in a vertical direction, when the conformable flapper valve 26*a* is attached to the drain valve main body 32*a*. As a result, in the first type drain valve device 4*a*, when the conformable flapper valve 26*a* is attached, the water discharge and water stop of the cleaning water may be performed without trouble.

As shown in FIGS. 5-7, the second type drain valve device 4*b* includes a flapper valve 26*b* and a drain valve body 32*b*, whose shape and dimension, etc. are different from the ones of the first type. Herein, the drain valve main body 32*b* includes a pair of supporting shafts 42*b* extending from a lower side of the overflow pipe 36*b* into a horizontal direction, and a valve seat 44*b* attached to a draining port 30*b* formed at the bottom surface 6 of the cleaning water tank 1. The flapper valve 26*b* includes engaging portions 46*b* which engages with the supporting shafts 42*b* and are capable of swinging in a vertical direction, a valve body 50*b* connected with the engaging portions 46*b* through extending portions 48*b* for carrying out a water discharge and a water stop when contacting with and separating from the valve seat 44*b* by swinging in the vertical direction. In the meantime, the projections (the first projections) 52 of the first type drain valve device 4*a* are not provided in the drain valve main body 32*b* of the second type drain valve device 4*b*.

Further, in the second type drain valve device 4*b*, projections (second projections) 54 which project downwardly are formed at the extending portions 48*b* of the flapper valve 26*b*. The projections 54 of the drain valve main body 32*b* in the second type drain valve device 4*b* are formed at a location where the projections 54 abut against the projections (the first projections) 52 of the first type drain valve main body 32*a*, when the flapper valve 26*b* in the second type drain valve device 4*b* is used in the first type drain valve device 4*a* by mistake.

In the second type drain valve device 4*b* such as described above, when the conformable flapper valve 26*b* is attached to the drain valve main body 32*b*, since the projections (the second projections) 54 of the flapper valve 26*b* do not abut against any part of the drain valve main body 32*b*. Therefore when water-discharging and water-stopping the cleaning water by swinging in a vertical direction, the water discharge and water stop of the cleaning water may be performed without trouble.

Figure 8:
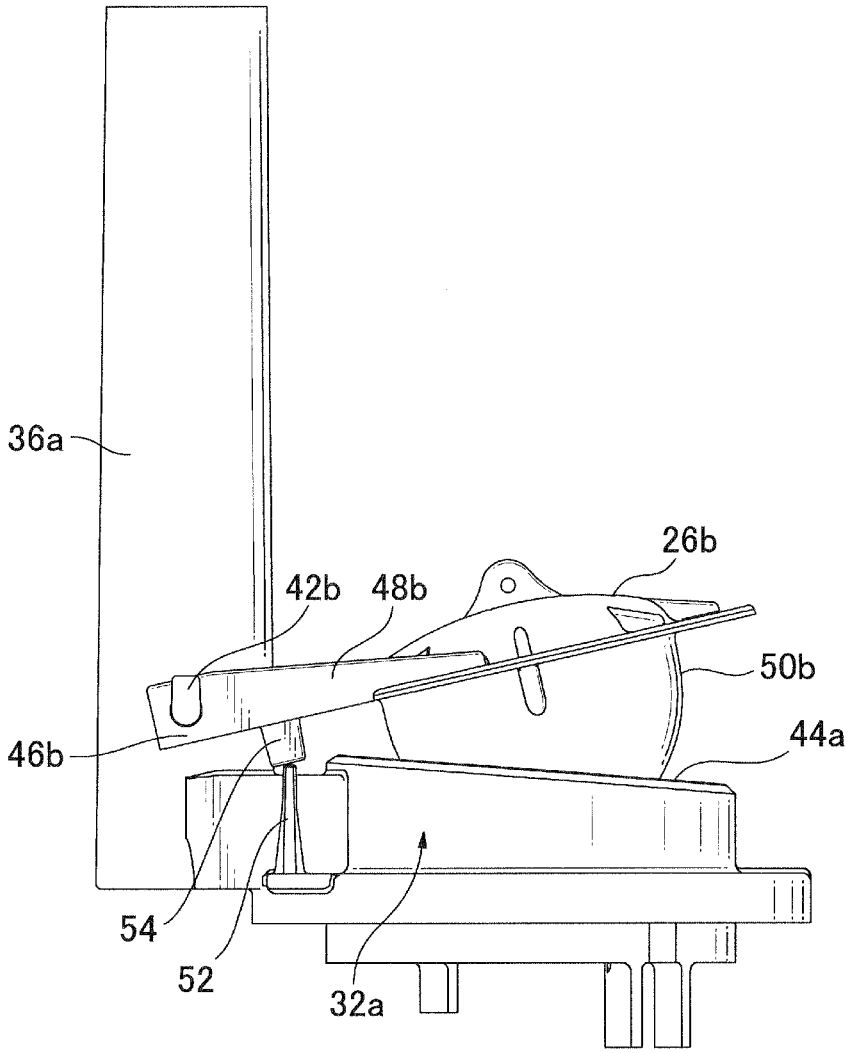
FIG. 8 is a front view showing the case where a non-formable flapper valve of the second type drain valve device is attached to a drain valve main body of the first type drain valve device by mistake, according to the embodiment of the present invention.

Hereinafter, the case where the non-conformable flapper valve 26*b* of the second type drain valve device 4*b* is attached to the drain valve main body 32*a* of the first type drain valve device 4*a* by mistake will be described, with reference to FIGS. 8 and 9. FIG. 8 is a front view showing the case where the non-conformable flapper valve 26*b* of the second type drain valve device 4*b* is attached to the drain valve main body 32*a* of the first type drain valve device 4*a* by mistake, and FIG. 9 is a perspective view of the same case as FIG. 8.

Figure 9:
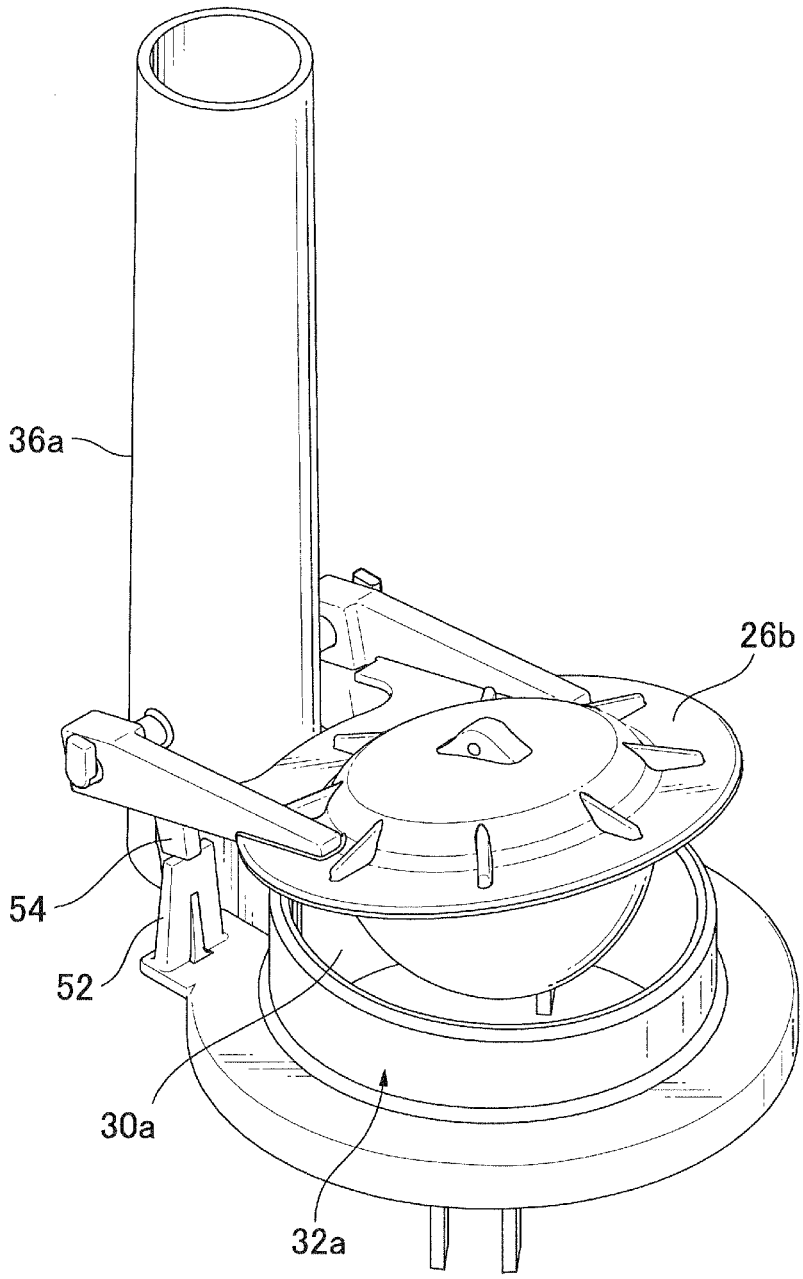
FIG. 9 is a perspective view showing the case where the non-conformable flapper valve of the second type drain valve device is attached to the drain valve body of the first type drain valve device by mistake, according to the embodiment of the present invention.

As shown in FIGS. 8 and 9, in the case where the non-conformable flapper valve 26*b* of the second type drain valve device 4*b* is attached to the drain valve main body 32*a* of the first type drain valve device 4*a* by mistake, a tip end of the projections (the first projections) 52 which upwardly project above the first type drain valve main body 32 and lower ends of the projections (the second projections) 54 which downwardly project below the second type non-conformable flapper valve 26*b* abut against each other, and the flapper valve 26*b* is in a non-closed state, and the draining port 30*a* is in an opened state. As a result, even when the water from the water supply device 2 is supplied into the cleaning water tank 1, the cleaning water is not stored in the cleaning water tank 1, and thus the worker will notice immediately that the attached flapper valve 26*b* is a non-conformable one.

Hereinafter, the shapes and dimensions of the first projections 52 of the drain valve main body 32*a* in the first type drain valve device 4*a* and the second projections 54 of the flapper valve 26*b* in the second type drain valve device 4*b* will be described, respectively.

Figure 10:
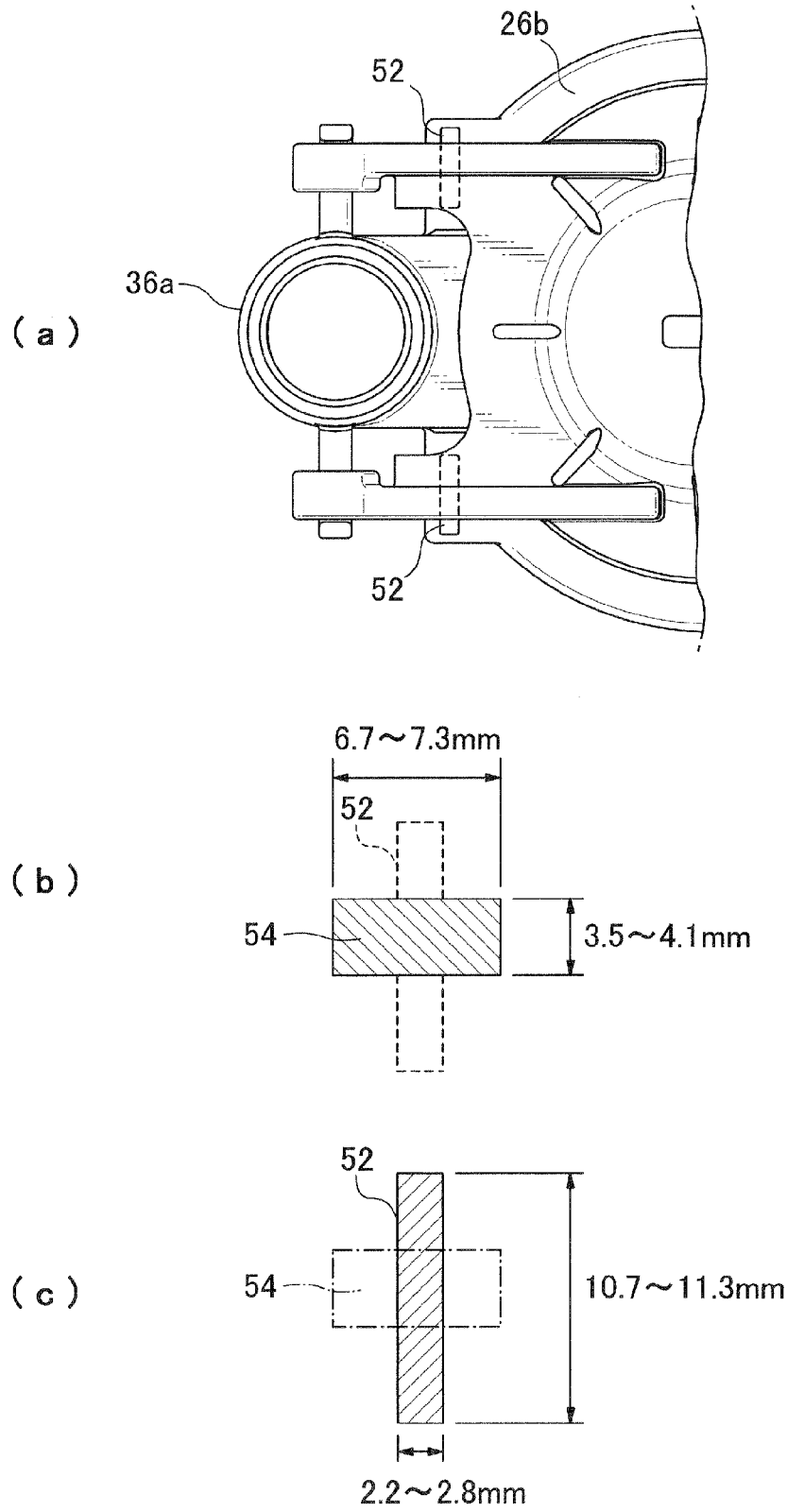
FIG. 10 (*a*) is a partially enlarged plan view showing the drain valve device in the state (see FIG. 8) where the non-conformable flapper valve is attached, FIG. 10 (*b*) is an enlarged plan view showing the lower end of a second projection of the non-conformable flapper valve, and FIG. 10 (*c*) is an enlarged plan view showing the upper end of a first protrusion in the drain valve main body.

FIG. 10 (*a*) is a partially enlarged plan view showing a drain valve device 4*a* in a state (see FIG. 8) where the non-conformable flapper valve 26*b* is attached, FIG. 10 (*b*) is an enlarged plan view showing the lower end of the second projection 54 in the non-conformable flapper valve 26*b*, and FIG. 10 (*c*) is an enlarged plan view showing the upper end of the first projection 52 in the drain valve main body 32*a*, respectively.

The aforementioned flapper valves 26*a* and 26*b*, each of which is made of an elastically deformable rubber, and is displaceable or movable in any of the X-axis direction (a width direction) and the Y-axis direction (a longitudinal direction), in a plan view. Accordingly, the shapes and dimensions of the flapper valves 26*a* and 26*b* are configures so that even when the flapper valve 26*b* is displaced or moved in the X-axis direction and the Y-axis direction in any fashion, the tip end of the first projection 52 in the firs type drain valve main body 32*a*, and the lower end of the second projection 54 in the second type non-conformable flapper valve 26*b* surely abut against each other. More specifically, the dimension of the lower end of the second projection 54 of the flapper valve 26*b* is 3.5 mm-4.1 mm in the X-axis direction (the width direction), and 6.7 mm-7.3 mm in the Y-axis direction (the longitudinal direction), while the dimension of the upper end of the first projection 52 in the drain valve main body 32*a* is 10.7 mm-11.3 mm in the X-axis direction (the width direction), and 2.2-2.8 mm in the Y-axis direction (the longitudinal direction), respectively.

As described above, according to the drain valve device in accordance with the present embodiment, when exchanging the flapper valve that is the drain valve, it is possible to securely prevent the non-conformable flapper valve from being attached.

Figure 11:
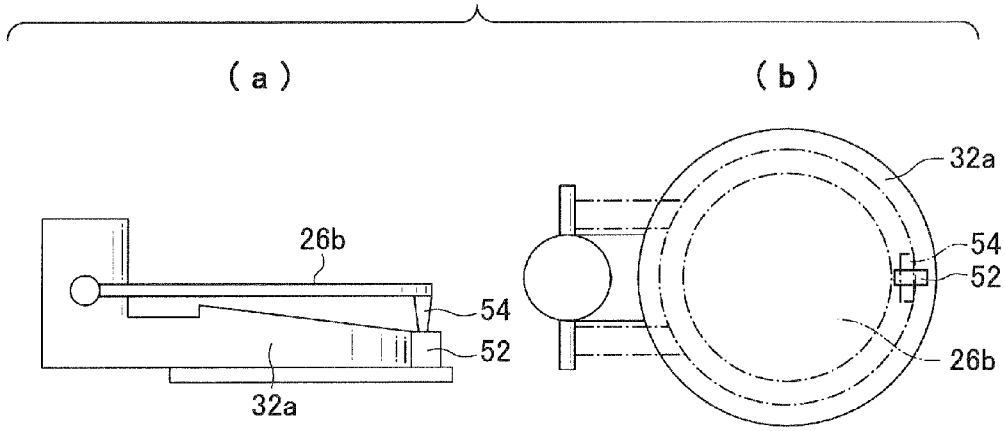
FIG. 11 (*a*) is a schematic front view showing a drain valve device in the state where a non-conformable flapper valve is attached according to a first alternative of the embodiment of the present invention, and FIG. 11 (*b*) is a schematic plan view in the same.

Hereinafter, a first alternative of the embodiment of the present invention will be described, with reference to FIG. 11. FIG. 11 (*a*) is a schematic front view showing the drain valve device in the state where the non-conformable flapper valve is attached according to the first alternative of the embodiment of the present invention, and FIG. 11 (*b*) is a schematic plan view in the same.

In the first alternative of the present embodiment, the second projection 54 of the flapper valve 26*b* is formed at a location where it is the furthest away from the engaging portion 46*b* of the valve main body 50*b* thereof, while the first projection 52 of the drain valve main body 32*a* is formed at a location which corresponds to the second projection 54 of the flapper valve 26*b*, that is a location where it is the furthest away from the supporting shaft 42*a* of the valve seat 44*a*.

In the drain valve device according to the first alternative, also, similar to the drain valve device according to the aforementioned present embodiment, when exchanging the flapper valve that is the drain valve, it will be immediately noticed that the attached flapper valve 26*b* is a non-conformable one, and as a result thereof, it is possible to securely prevent the non-conformable flapper valve from being attached.

Figure 12:
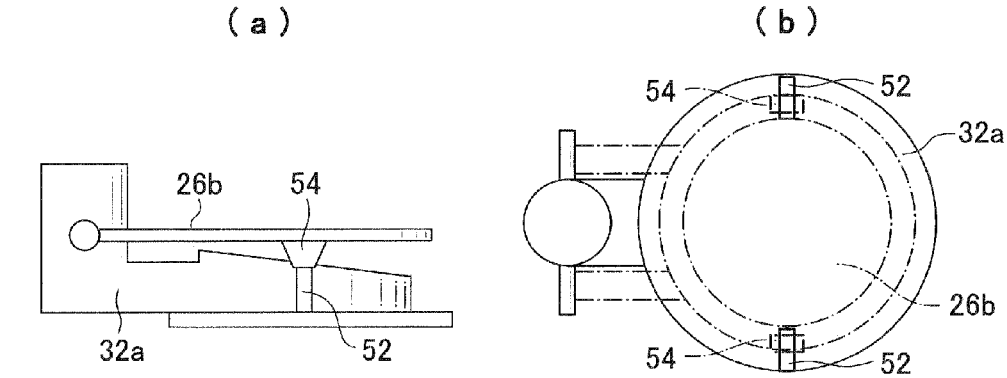
FIG. 12 (*a*) is a schematic front view showing a drain valve device in the state where a non-conformable flapper valve is attached according to a second alternative of the embodiment of the present invention, and FIG. 12 (*b*) is a schematic plan view in the same.

A second alternative of the embodiment of the present invention will be described with reference to FIG. 12. FIG. 12 (*a*) is a schematic front view showing the drain valve device in the state where the non-conformable flapper valve is attached according to the second alternative of the embodiment of the present invention, and FIG. 12 (*b*) is a schematic plan view in the same.

In the second alternative of the present embodiment, the second projections 54 of the flapper valve 26*b* are formed at opposite sides of the valve body 50*b* thereof, while the first projections 52 of the drain valve body 32*a* are formed at locations which correspond to the second projections 54 of the flapper valve 26*b*, that is locations at opposite sides of the valve seat 44*a*.

In the drain valve device according to the second alternative, also, similar to the drain valve device according to the aforementioned present embodiment, when exchanging the flapper valve that is the drain valve, it will be immediately noticed that the attached flapper valve 26*b* is a non-conformable one, and as a result thereof, it is possible to securely prevent the non-compliant flapper valve from being attached.

Figure 13:
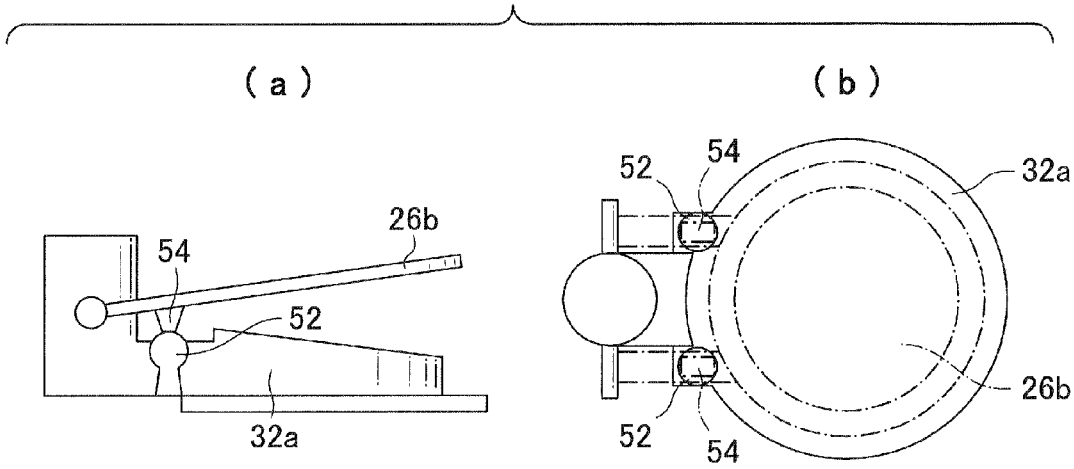
FIG. 13 (*a*) is a schematic front view showing a drain valve device in the state where a non-conformable flapper valve is attached according to a third alternative of the embodiment of the present invention, and FIG. 13 (*b*) is a schematic plan view in the same.

A third alternative of the embodiment of the present invention will be described with reference to FIG. 13. FIG. 13 (*a*) is a schematic front view showing the drain valve device in the state where the non-conformable flapper valve is attached according to the third alternative of the embodiment of the present invention, and FIG. 13 (*b*) is a schematic plan view in the same.

In the third alternative of the present embodiment, although the location of the second projections 54 of the flapper valve 26*b*, and the location of the first projections 52 of the drain valve main body 32*a* are, respectively, the same as the ones in the above-described embodiments, the upper end of the first projection 52 in the drain valve main body 32*a* is in a spherical shape (or a hemispherical shape), in the third alternative.

In the drain valve device according to the third alternative, also, similar to the drain valve device according to the aforementioned present embodiment, when exchanging the flapper valve that is the drain valve, it will be immediately noticed that the attached flapper valve 26*b* is a non-conformable one, and as a result thereof, it makes possible to securely prevent the non-compliant flapper valve from being attached.

Figure 14:
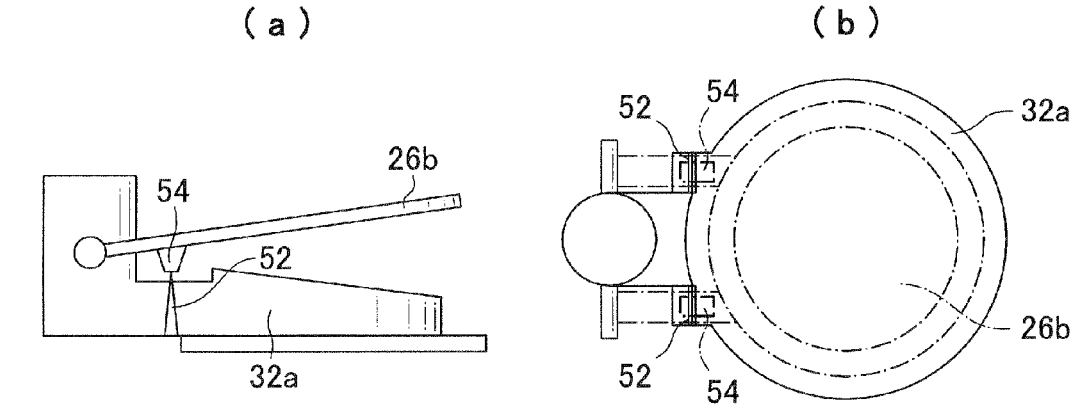
FIG. 14 (*a*) is a schematic front view showing a drain valve device in the state where the non-conformable flapper valve is attached according to a fourth alternative of the embodiment of the present invention, and FIG. 14 (*b*) is a schematic plan view in the same.

A fourth alternative of the embodiment of the present invention will be described according to FIG. 14. FIG. 14 (*a*) is a schematic front view showing the drain valve device in the state where the non-conformable flapper valve is attached according to the fourth alternative of the embodiment of the present invention, and FIG. 14 (*b*) is a schematic plan view in the same.

In the fourth alternative of the present embodiment, although the location of the second projections 54 of the flapper valve 26*b*, and the location of the first projections 52 of the drain valve body 32*a* are, respectively, the same as the ones in the above-described embodiments, the upper end of the first projection 52 in the drain valve main body 32*a* is in a linear shape, in the fourth alternative.

In the drain valve device according to the fourth alternative, also, similar to the drain valve device according to the aforementioned present embodiment, when exchanging the flapper valve that is the drain valve, it will be immediately noticed that the attached flapper valve 26*b* is a non-conformable one, and as a result thereof, it is possible to securely prevent the non-compliant flapper valve from being attached.

According to the drain valve device for the cleaning water tank, and the drain valve or the flapper valve for the drain valve device of the present invention, when exchanging the drain valve, it is possible to prevent a non-conformable drain valve from being attached.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A first type drain valve device for a cleaning water tank which stores a cleaning water for cleaning a toilet bowl, said first type drain valve device comprising:

a first type drain valve main body including a supporting shaft extending in a horizontal direction and a valve seat attached to a draining port formed at a bottom surface of the cleaning water tank; and a first type drain valve including an engaging portion which engages with the supporting shaft and is capable of swinging in a vertical direction, and a valve body, connected with the engaging portion through an extending portion, for carrying out a water discharge and a water stop when contacting with or separating from the valve seat by swinging in a vertical direction, wherein said first type drain valve main body includes a first projection which projects upwardly, when said first type drain valve is attached to the first type drain valve main body, the first type drain valve main body enables carrying out a water discharge and a water stop, without the first projection abutting against the first type drain valve, and when a second type drain valve provided with a second projection is attached to the first type drain valve main body, the first type drain valve main body disenables carrying out a water stop, with the first projection abutting against the second projection of the second type drain valve;

wherein said second projection of the second type drain valve is provided at the extending portion of the second type drain valve.

2. The drain valve device according to claim 1, wherein said first projection of the first type drain valve main body or said second projection of the second type drain valve has a length so that it enables abutting against the second projection of the second type drain valve or the first projection of the first type drain valve main body, respectively, when the first type drain valve or the second type drain valve is displaced or moved in a direction in which the supporting shaft extends.

3. A second type drain valve for use in a second type drain valve device of a cleaning water tank which stores a cleaning water for cleaning a toilet bowl, said second type drain valve device comprising a second type drain valve main body which includes a supporting shaft extending in a horizontal direction, and a valve seat attached to a draining port formed at a bottom surface of the cleaning water tank; said second type drain valve comprising:

an engaging portion which engages with the supporting shaft and is capable of swinging in a vertical direction;

a valve body, connected with the engaging portion through an extending portion, for carrying out a water discharge and a water stop when contacting with or separating from the valve seat by swinging in a vertical direction; and a second projection which projects downwardly;

wherein said second type drain valve enables carrying out a water discharge and a water stop when the second type drain valve is attached to the second type drain valve main body, and the second type drain valve disenables carrying out a water stop when the second type drain valve is attached to a first type drain valve main body, which is different from the second type drain valve main body with the second projection abutting against a first projection projecting upwardly provided at the first type drain valve main body;

wherein said second projection of the second type drain valve is provided at the extending portion of the drain valve.

4. The drain valve according to claim 3, wherein the second projection of the second type drain valve has a length so that it enables abutting against the first projection of the first type drain valve main body when the first type drain valve or the second type drain valve is displaced or moved in a direction in which the supporting shaft extends.

* * * * *